US006156440A

United States Patent [19]

Suwa et al.

[11] Patent Number: 6,156,440

[45] Date of Patent: Dec. 5, 2000

[54] MATERIAL FOR USE IN AN APPARATUS CONTACTING ORGANIC AMINES

[75] Inventors: Takeshi Suwa; Mitsuru Shinkoda, both of Kobe, Japan

[73] Assignee: Shinko Pantec Co., Ltd., Hyogo, Japan

[21] Appl. No.: 08/888,523

[22] Filed: Jul. 7, 1997

[30] Foreign Application Priority Data

Jul. 11, 1996 [JP] Japan ..... 8-182277

[51] Int. Cl.[7] ..... B32B 15/04

[52] U.S. Cl. ..... 428/472.1; 148/606; 148/286

[58] Field of Search ..... 428/472.1, 472.2, 428/472.3; 148/606, 248, 274, 286, 287

[56] References Cited

U.S. PATENT DOCUMENTS

| | | | |
|---|---|---|---|
| 3,673,251 | 6/1972 | Frampton et al. | 260/563 |
| 4,364,900 | 12/1982 | Burrill | 376/306 |
| 4,518,440 | 5/1985 | Philips, Jr. | 428/472.2 |
| 4,636,266 | 1/1987 | Asay . | |
| 5,139,623 | 8/1992 | Ohmi et al. | 204/129.1 |
| 5,226,968 | 7/1993 | Ohmi et al. . | |

OTHER PUBLICATIONS

Merriman, A.D., "A Dictionary of Metallurgy", MacDonald and Evans Ltd, London, p. 338, 1958.

*Primary Examiner*—John Sheehan
*Assistant Examiner*—Andrew L. Oltmans
*Attorney, Agent, or Firm*—Marshall, O'Toole, Gerstein, Murray & Borun

[57] ABSTRACT

A treated stainless steel is used as the material of construction for parts of an apparatus exposed to an organic amine. The stainless steel is treated by cleaning the stainless steel, forming a colored oxide film on the surface of the cleaned stainless steel by heating the cleaned stainless steel in an oxidizing atmosphere, and removing a portion of the colored oxide film to expose a passivating oxide film.

26 Claims, 2 Drawing Sheets

MATERIAL FOR USE IN AN APPARATUS CONTACTING ORGANIC AMINES

FIELD OF THE INVENTION

The present invention relates to a material of construction having sufficient anticorrosion properties against organic amines, wherein an extremely small amount of metallic ions are leached from the material into an organic amine agent. The organic amine agent is used in semiconductor producing processes, liquid crystal material producing processes, high purity agent producing processes, and the like, wherein it is desirable to minimize leaching of metallic ions into the organic amine agent.

DESCRIPTION OF PRIOR ART

In the prior art, various proposals have been made to suppress the leaching of metallic ions from a metal apparatus. It is a well-known method to polish and flatten a stainless steel surface such that leaching of metallic ions is suppressed. Such stainless steel is now widely used as the basic material of construction of an apparatus and/or a plant, such as storage tanks, pipes, and valves. For example, when stainless steel is polished by means of buff finishing, the stainless steel surface is scratched and a granular texture is formed. Accordingly, a passive film comprising iron oxides, chromium oxide, and nickel oxide is not uniformly formed. As a result, in cases wherein the passive film is exposed to an organic amine, the concentration of metallic ions leached from the stainless steel surface reaches a level that is measured in parts per million (ppm). In other words, the concentration of metallic ions leaching from the stainless steel is substantial. A stainless steel having such a concentration of metallic ions leaching therefrom should not be used in the above-mentioned production processes, wherein leaching of metallic ions is not substantially permitted.

On the other hand, when stainless steel is polished by means of an electrolytic polishing process, the scratched and granular texture of the stainless steel is removed by electrochemical dissolution, and a surface having a sound texture, free from working deterioration, is formed. However, the thickness of a passive oxide film formed on the surface of stainless steel by air is the range of about 5 to 15 angstroms (Å). In this process, the produced passive film therefore is very thin. Consequently, if the stainless steel is exposed to an organic amine for an extended time, leaching of metallic ions from the stainless steel surface cannot be prevented. As a result, the yield of useful products is reduced because of quality degradation.

In addition to stainless steel, fluororesin and quartz glass typically are used as the basic anticorrosion material of construction for an apparatus. But, if a fluororesin is exposed to an organic amine for an extended time, fluoride and organic carbon contained in resin are easily leached from the resin, and a sludge particle can be generated. As a result, the yield of useful products is reduced because of quality degradation, as described above. In addition, it is difficult to perform the complicated manufacturing procedures required when using quartz glass. Furthermore, quartz glass is fragile, and it is difficult, if not impossible, to use quartz glass in an apparatus that is subjected to an external force.

In view of the above problems, the present invention is directed to a basic material of construction for an apparatus, wherein the apparatus has excellent anticorrosion properties, even when exposed to an organic amine for an extended time.

SUMMARY OF THE INVENTION

In accordance with one aspect of the invention, a material of construction for use in an apparatus that contacts an organic amine agent is provided. For example, a stainless steel, which is exposed to an organic amine, is treated by the process steps described below, prior to exposure to the organic amine.

In accordance with another aspect of the invention, a material of construction for use in semiconductor producing apparatus and/or liquid crystal producing apparatus is provided. For example, a stainless steel, which is exposed to an organic amine is treated by the process steps described below, prior to exposure to the organic amine.

The stainless steel treatment comprises steps of: cleaning a surface of a stainless steel, forming a colored oxide film on the cleaned stainless steel surface by heating said cleaned stainless steel in oxidizing atmosphere, and dissolving said colored oxide film. This treated stainless steel is used as the material of construction for parts of an apparatus exposed to an organic amine.

A colored oxide film formed on the cleaned stainless steel surface contains a large ferrous iron oxide component, while a relatively large amount of chromium and nickel oxides are positioned at the boundary layer between the colored oxide film and the substratum base metal. Accordingly, a boundary layer containing a substantial amount of chromium oxide is exposed by removing the colored oxide film containing the ferrous iron component. Leaching of metallic ions from the stainless steel therefore is suppressed by the passive film of chromium oxide or chromium oxide hydrate.

A desirable stainless steel treatment is accomplished by following the first through the third process steps. The first process step comprises cleaning a stainless steel, for example, by means of electrolytic polishing. The second process step comprises heating said cleaned stainless steel at the temperature of about 350° C. to 700° C., in an oxidizing atmosphere, to form a colored oxide film on the cleaned stainless steel. The third treatment process step comprises dissolving and removing a sufficient amount of said colored oxide film by acid or electrolytic treatment to expose a chromium oxide layer on the stainless steel. Air or an oxygen and nitrogen atmosphere are nonlimiting examples of an oxidizing atmosphere.

When the heating temperature is less than about 350° C., the formation of a passive film is imperfect. If the heating temperature is greater than about 450° C., the colored oxide film becomes excessively thick and fragile. When the stainless steel is heated at the temperature of about 450° C. to about 700° C., a chrome carbide precipitates in the passive film and a stress corrosion may occur. Accordingly, it is preferred that the heating temperature of stainless steel is about 350° C. to about 450° C.

When the heating time at said temperature (about 350° C. to about 450° C.) is less than about 15 minutes, the formation of the colored oxide film can be imperfect. If the heating time is greater than about 30 minutes, the colored oxide film can be too thick.

In accordance with the material of construction of the present invention, the colored oxide film, comprising of iron oxides, chromium oxide, and nickel oxide and the like (e.g., $Fe_2O_3$, FeO, $Fe_3O_4$, $Cr_2O_4$, and NiO), is formed on the surface of the cleaned stainless steel by heating the cleaned stainless steel in an oxidizing atmosphere. Iron, chromium, and nickel each has a specific oxidation rate. As a result, a large amount of a ferrous oxide is present in the colored oxide film, and a large amount of both chromium and nickel oxide are present in a boundary layer positioned between the colored oxide film and the substratum base metal. Accordingly, the boundary layer containing a large quantity of chromium and nickel oxides is exposed by dissolving and removing the colored oxide film containing a large quantity of ferrous oxide. The remaining passive film of chromium oxide suppresses leaching of metallic ions from the stainless steel.

DETAILED DESCRIPTION OF THE PREFERRED EMBODIMENTS

Figure 1:
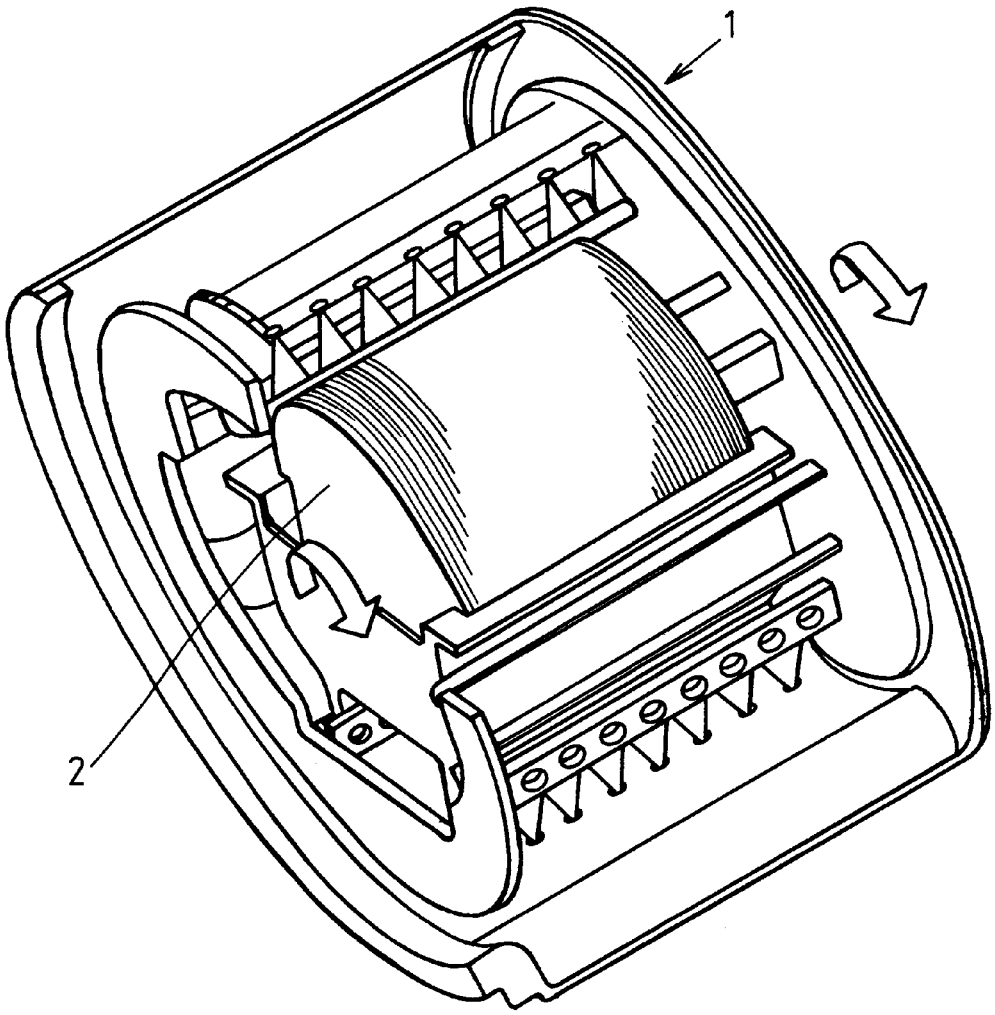
FIG. 1 is a cutaway perspective view of an apparatus that contacts an organic amine agent.

A preferred embodiment is described with reference to the figures. In an integrated circuit-producing process or a semiconductor-producing process, an example of treating processes, such as removal of polymer or stripping of photoresist by organic solvent and stripping agent, is done in rotating cylindrical receptacle 1, as shown in FIG. 1 and according to the following process.

The first step is a washing process using isopropyl alcohol. The second step is a stripping process of photoresist from a plurality of silicon wafers 2 within receptacle 1 by a stripping agent. The third step is a washing process using isopropyl alcohol. The fourth step is a washing process using pure water. The fifth step is a drying process of silicon wafers 2. The object of the present invention is to provide a material of construction having good anticorrosion properties against the organic amine used as the stripping agent in said process. Additionally, as shown in FIG. 1, it is difficult to manufacture a cylindrical receptacle from quartz glass because of its complicated shape.

After the stripping agent in receptacle 4 was discarded, a fresh portion of organic amine stripping agent (100 ml) was added to receptacle 4. The water temperature of water tank 7 was maintained at 80° C. by heater 6. Two days later, namely three days after beginning the test, the amount of metallic ion that leached into the stripping agent in receptacle 4 was measured by the same method as above. After the stripping agent in receptacle 4 was discarded, another fresh portion of organic amine stripping agent (100 ml) was added to receptacle 4. The water temperature of water tank 7 was maintained at 80° C. by heater 6. Four days later, namely seven days after beginning of test, the amount of metallic ion leached into the stripping agent in receptacle 4 was measured by the same method as above. The amount of metallic ion leached into solution in receptacle 4 also was measured fourteen days and twenty-eight days after beginning of test by the same method as above.

The following agents were used as the organic amine stripping agents. One is an original liquid obtained by mixing monoethanolamine with dimethyl sulfoxide at ratio of about three to seven. Another is a liquid obtained by adding five percent by weight water to said original liquid. After electrolytic polishing, the test piece was heated for thirty minutes at 450° C. in an air atmosphere, and the colored oxide film of the test piece was removed by one normal hydrochloric acid. It also is possible to use sulfuric acid as a substitute for hydrochloric acid as an acid for the purpose of stripping the colored oxide film. Also, in comparison with the above embodiment, the amount of metallic ion leached from test pieces that were merely electrolytically polished also was measured by the same method as above.

The results of the metallic ion leaching test are summarized in Table 1.

TABLE 1

| | | Present Invention (parts per billion) | | | | | Comparison (parts per billion) | | | | |
|---|---|---|---|---|---|---|---|---|---|---|---|
| Stripping Agent | Element | 1 day after | 3 days after | 7 days after | 14 days after | 28 days after | 1 day after | 3 days after | 7 days after | 14 days after | 28 days after |
| Original liquid | Fe | 0 | 0 | 4 | 0 | 1 | 63 | 21 | 34 | 9 | 94 |
| | Cr | 3 | 1 | 2 | 0 | 1 | 6 | 3 | 7 | 2 | 7 |
| | Ni | 1 | 1 | 2 | 0 | 1 | 2 | 3 | 2 | 0 | 3 |
| | Mo | 1 | 2 | 2 | 0 | 3 | 3 | 5 | 3 | 3 | 3 |
| | Total of Elution | 5 | 4 | 10 | 0 | 6 | 74 | 32 | 46 | 14 | 107 |
| Adding five percent by weight water to original liquid | Fe | 1 | 0 | 0 | 0 | 3 | 77 | 22 | 17 | 12 | 22 |
| | Cr | 4 | 0 | 1 | 0 | 2 | 9 | 0 | 3 | 4 | 6 |
| | Ni | 1 | 2 | 2 | 0 | 2 | 3 | 4 | 2 | 1 | 2 |
| | Mo | 0 | 2 | 2 | 0 | 2 | 2 | 4 | 2 | 0 | 2 |
| | Total of Elution | 6 | 4 | 5 | 0 | 9 | 91 | 30 | 24 | 17 | 32 |

Figure 2:
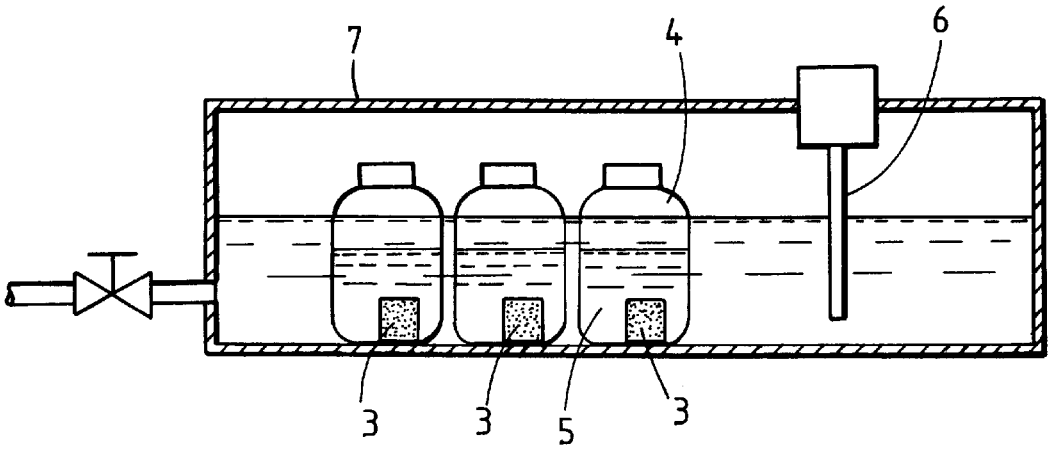
FIG. 2 illustrates an apparatus and a method of testing for leaching of metallic ions from a metal substrate.

A test to determine the amount of leached metallic ions was conducted using an experimental device as shown in FIG. 2. A test piece 3 of stainless steel was immersed in 100 milliliters (ml) of organic amine stripping agent 5 in receptacle 4. The size of test piece 3 was 2 millimeters (mm) thick, 30 mm wide, 40 mm long. The temperature of water in a water tank 7, in which receptacle 4 was immersed, was maintained at 80° C. by a heater 6. One day later, the amount of metallic ions that leached into the stripping agent in receptacle 4 was measured by induction combined plasma mass spectrometer.

As clearly shown in Table 1, very low amounts of metallic ion leach out from the test pieces of the present invention. In contrast, a remarkably large quantity of iron ion leaches from the test pieces of the comparative examples.

Furthermore, another metallic ion leaching test using the same method as above was conducted, except that the receptacle holding the organic amine stripping agent was immersed in an oil bath and the temperature of the oil bath was maintained at 120° C. In this test, the results were almost identical to the results of the test performed at 80° C.

In accordance with the present invention, it is possible to provide a stainless steel material of construction, wherein only very low amounts of metallic ion leaches into an organic amine stripping agent.

What is claimed is:

1. A material of construction for use in an apparatus that contacts an organic amine, said material comprising treated stainless steel which has been prepared by the steps of cleaning a stainless steel by electrolytic polishing, then forming a colored oxide film on the surface of the cleaned stainless steel by heating the cleaned stainless steel in an oxidizing atmosphere, and then removing a portion of the colored oxide film to expose a passive film of chromium oxide.

2. The material of claim 1 wherein the cleaned stainless steel is heated at a temperature of about 350° C. to about 700° C.

3. The material of claim 1 wherein the cleaned stainless steel is heated at a temperature of about 350° C. to about 450° C.

4. The material of claim 1 wherein the cleaned stainless steel is heated for about 15 to about 30 minutes.

5. The material of claim 1 wherein the oxidizing atmosphere comprises air or oxygen mixed with an inert gas.

6. The material of claim 1 wherein the colored oxide film is removed using an acid.

7. The material of claim 1 wherein the colored oxide film is removed electrolytically.

8. The material of claim 1 wherein the step of removing a portion of the colored oxide film removes ferrous iron oxides to expose a passive film of chromium oxide.

9. A semiconductor producing apparatus comprising treated stainless steel, wherein said treated stainless steel has been produced by a method comprising cleaning a stainless steel by electrolytic polishing, then forming a colored oxide film on the surface of the cleaned stainless steel by heating said cleaned stainless steel in an oxidizing atmosphere, and then removing a portion of the colored oxide film to expose a passive film of chromium oxide.

10. A liquid crystal producing apparatus comprising treated stainless steel, wherein said treated stainless steel has been produced by a method comprising cleaning a stainless steel by electrolytic polishing, then forming a colored oxide film on the surface of the cleaned stainless steel by heating said cleaned stainless steel in an oxidizing atmosphere, and then removing a portion of the colored oxide film to expose a passive film of chromium oxide.

11. A material of construction for use in an apparatus that contacts an organic amine, said material comprising treated stainless steel which has been prepared by the steps of cleaning a stainless steel by electrolytic polishing, then forming a colored oxide film on the surface of the cleaned stainless steel by heating the cleaned stainless steel in an oxidizing atmosphere, and then removing a portion of the colored oxide film to expose a passive film of chromium oxide.

12. A method of reducing an amount of metal ions leached from stainless steel in contact with an organic amine, comprising:

(a) providing a treated stainless steel which has been prepared by the steps of cleaning a stainless steel by electrolytic polishing, then forming a colored oxide film on the surface of the cleaned stainless steel by heating the cleaned stainless steel in an oxidizing atmosphere, and then removing a portion of the colored oxide film to expose a passive film of chromium oxide; and (b) contacting the treated stainless steel with the organic amine.

13. A method of manufacturing a treated stainless steel having an improved ability to suppress leaching of metal ions from the treated stainless steel, said method comprising the steps of:

(a) cleaning an untreated stainless steel by electrolytic polishing;

(b) then heating the cleaned stainless steel in an oxidizing atmosphere to form a chromium oxide boundary layer in contact with untreated stainless steel and a colored, substantially ferrous oxide film over the boundary layer; and (c) then treating the stainless steel of step (b) which has been heated with a sufficient amount of acid for a sufficient time to remove the colored oxide film and expose the chromium oxide boundary layer, wherein an amount of metal ions leached from the treated stainless steel is about 24 to about 25 ppb after contact with an organic amine for up to 28 days.

14. A material of construction for use in an apparatus that contacts an organic amine, said material comprising treated stainless steel which has been prepared by the steps of cleaning a stainless steel by electrolytic polishing, then forming a colored oxide film or the surface of the cleaned stainless steel by heating the cleaned stainless steel in an oxidizing atmosphere, and then removing a portion of the colored oxide film to expose a passive film comprising chromium oxide.

15. The material of claim 14 wherein the cleaned stainless steel is heated at a temperature of about 350° C. to about 700° C.

16. The material of claim 14 wherein the cleaned stainless steel is heated at a temperature of about 350° C. to about 450° C.

17. The material of claim 14 wherein the cleaned stainless steel is heated for about 15 to about 30 minutes.

18. The material of claim 14 wherein the oxidizing atmosphere comprises air or oxygen mixed with an inert gas.

19. The material of claim 14 wherein the colored oxide film is removed using an acid.

20. The material of claim 14 wherein the colored oxide film is removed electrolytically.

21. The material of claim 14 wherein the step of removing a portion of the colored oxide film removes ferrous iron oxides to expose a passive film comprising chromium oxide.

22. A semiconductor producing apparatus comprising treated stainless steel, wherein said treated stainless steel has been produced by a method comprising cleaning a stainless steel by electrolytic polishing, then forming a colored oxide film on the surface of the cleaned stainless steel by heating said cleaned stainless steel in an oxidizing atmosphere, and then removing a portion of the colored oxide film to expose a passive film comprising chromium oxide.

23. A liquid crystal producing apparatus comprising treated stainless steel, wherein said treated stainless steel has been produced by a method comprising cleaning a stainless steel by electrolytic polishing, then forming a colored oxide film on the surface of the cleaned stainless steel by heating said cleaned stainless steel in an oxidizing atmosphere, and then removing a portion of the colored oxide film to expose a passive film comprising chromium oxide.

24. A material of construction for use in an apparatus that contacts an organic amine, said material comprising treated stainless steel which has been prepared by the steps of cleaning a stainless steel by electrolytic polishing, then forming a colored oxide film on the surface of the cleaned stainless steel by heating the cleaned stainless steel in an oxidizing atmosphere, and then removing a portion of the colored oxide film to expose a passive film comprising chromium oxide.

25. A method of reducing an amount of metal ions leached from stainless steel in contact with an organic amine, comprising:

(a) providing a treated stainless steel which has been prepared by the steps of cleaning a stainless steel by electrolytic polishing, then forming a colored oxide film on the surface of the cleaned stainless steel by heating the cleaned stainless steel in an oxidizing atmosphere, and then removing a portion of the colored oxide film to expose a passive film comprising chromium oxide; and (b) contacting the treated stainless steel with the organic amine.

26. A method of manufacturing a treated stainless steel having an improved ability to suppress leaching of metal ions from the treated stainless steel, said method comprising the steps of:

(a) cleaning an untreated stainless steel by electrolytic polishing;

(b) then heating the cleaned stainless steel in an oxidizing atmospheres to form a boundary layer containing a large quantity of chromium and nickel oxides in contact with untreated stainless steel and a colored, substantially ferrous oxide film over the boundary layer; and (c) then treating the stainless steel of step (b) which has been heated with a sufficient amount of acid for a sufficient time to remove the colored oxide film and expose the boundary layer containing a large quantity of chromium and nickel oxides, wherein an amount of metal ions leached from the treated stainless steel is about 24 to about 25 ppb after contact with an organic amine for up to 28 days.

* * * * *